United States Patent [19]

Vota

[11] Patent Number: 4,488,816

[45] Date of Patent: Dec. 18, 1984

[54] APPARATUS FOR THE GENERATION AND THE AUTOMATIC CONTROL OF ULTRASONIC WAVES IN THE TREATMENT OF FLUIDS

[76] Inventor: Mario F. Vota, Viale Lombardia, 188, Brugherio (Province of Milano), Italy

[21] Appl. No.: 453,187

[22] Filed: Dec. 27, 1982

[51] Int. Cl.[3] ..... B01F 11/02

[52] U.S. Cl. ..... 366/116; 73/54; 366/127; 366/142

[58] Field of Search ..... 366/108, 114, 116, 127, 366/142; 73/54, 61 R, 61.1 R, 861.25, 861.27, 861.28; 310/335, 336

[56] References Cited

U.S. PATENT DOCUMENTS

| | | | |
|---|---|---|---|
| 3,167,669 | 1/1965 | Bodine, Jr. | 366/114 X |
| 3,254,284 | 5/1966 | Tomes | 366/114 X |
| 3,885,902 | 5/1975 | Fujieda et al. . | |
| 3,931,533 | 1/1976 | Raso et al. . | |
| 4,135,387 | 1/1979 | Benedict . | |
| 4,391,149 | 7/1983 | Herzl | 73/861.25 |
| 4,397,194 | 8/1983 | Soltz | 73/861.28 |

FOREIGN PATENT DOCUMENTS

| | | | |
|---|---|---|---|
| 27936 | 2/1980 | Japan | 73/861.28 |
| 808854 | 2/1981 | U.S.S.R. | 73/861.28 |

OTHER PUBLICATIONS

Control & Instrumentation, vol. 12, 1980, Feb., No. 2, London, GB, "Coherent Modulation Applied to Ultrasonic Measurement Systems", pp. 43–44.

*Primary Examiner*—Philip R. Coe

*Attorney, Agent, or Firm*—Guido Modiano; Albert Josif

[57] ABSTRACT

This apparatus is used in industrial treatment processes for fluids constituted of several chemical components which must be perfectly homogenized before taking part in processes, when it is necessary to achieve saturation conditions closest to the stoichiometric conditions. This apparatus is suitable to generate ultrasonic waves of manifold frequencies depending on the viscosity of treated fluid and with its flux velocity inside a duct. The apparatus consists in an ultrasonic waves generator which sends treatment-waves in a duct, to homogenize the arriving fluid by means of a newly conceived transducer which, in the meantime, sends also a beam of controlling waves to detect the achieved homogeneity of treated fluid. Controlling waves are analyzed by binary circuits which accept or reject signals, maintaining or changing the balance between received signals and generated signals until the right frequency of waves is sent to treatment transducer to insure the proper homogenization of the fluid.

3 Claims, 1 Drawing Figure

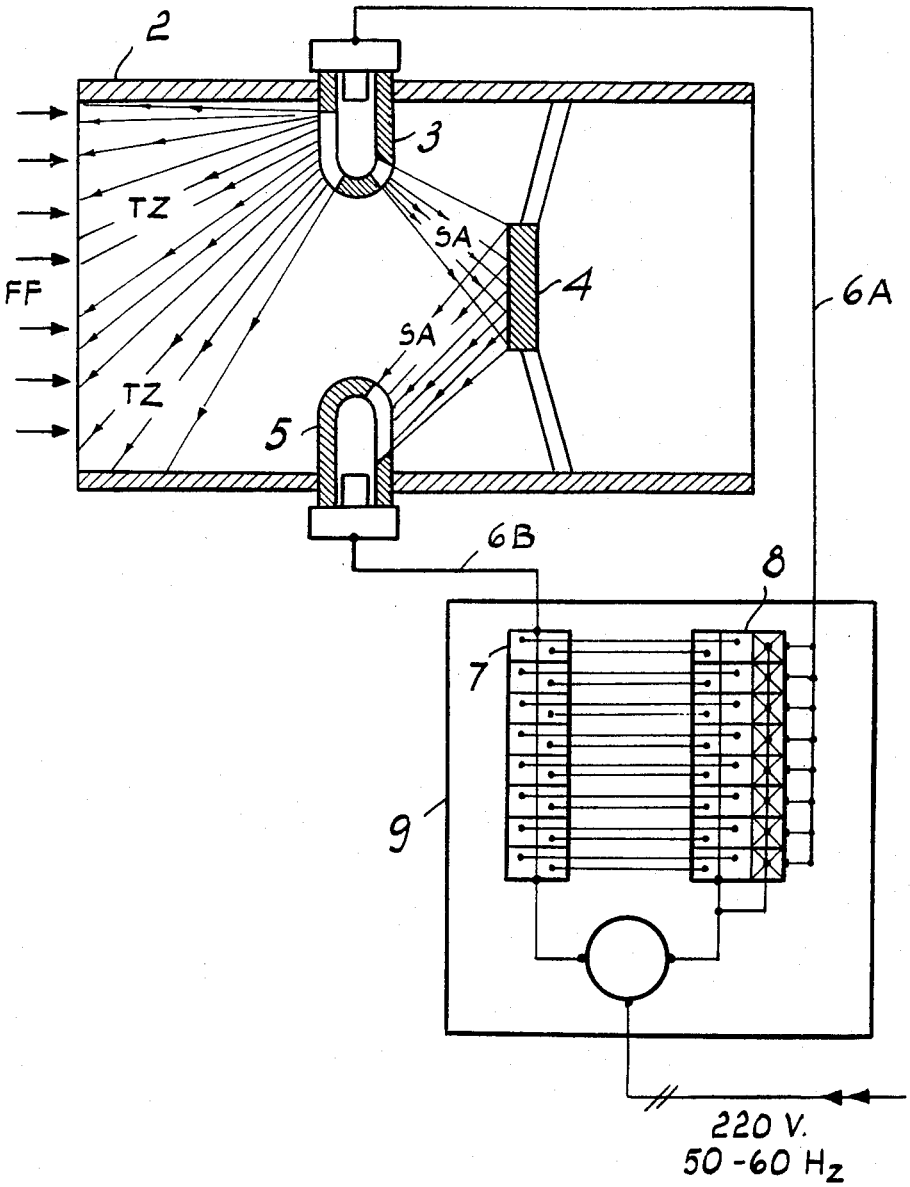
2
3
TZ
SA
4
FF
SA
6A
TZ
5
6B
8
7
9
220 V.
50 -60 Hz

APPARATUS FOR THE GENERATION AND THE AUTOMATIC CONTROL OF ULTRASONIC WAVES IN THE TREATMENT OF FLUIDS

BACKGROUND OF THE INVENTION

This invention relates to a system of electric and mechanical devices which generate, transduce, induce, detect, rectify and control a flux of ultrasonic waves on the basis of preset parameters.

This apparatus is used in the treatment processes of fluids comprising several chemical components, when in an industrial process it is necessary to achieve saturation conditions closest to the stoichiometric conditions, at the end of process. As a non limitative example of its applications the following list of involved processes is mentioned:

the use of industrial paints by means of robots, the blend between additives and lubrificant oils, the manifold blendings of fluids in petroleum, petrochemical, chemical fields and food industry, the industrial waters treatments, the combustion and the drying of several materials.

It is well known that ultrasonic waves are applied in the industrial field as well as in the scientific field. Following are quotations from known publications: On page 240 of the book "La Combustione" by Prof. Giuliano Salvi, Tamburini Editore, Milan, issued in 1968, there is described the atomizer of Mr. J. G. Martner, which makes use of a piezoelectric disc connected with an aluminum device, to atomize light liquid fuels up to kerosene; from page 179 to page 191 of the review "La Termotecnica" Vol. XXVII n. 4, year 1973, the author Prof. Giovanni Vulpetti illustrates the "Experiment analysis for temperature measurements with sound speed in supersonic gas flux".

The apparatus of the present invention performs the treatment of fluids comprising several chemical components, in motion inside a duct, with the purpose of making them homogeneous. The invention consists of an apparatus comprising a generator of ultrasonic waves of new conception and a transducer-receiver also of new conception, the apparatus is suitable for homogenization treatment of fluids in motion inside a duct. These two equipments operate in symbiosis. The generator of ultrasonic waves, elaborating the coming signals from the transducer-receiver, is able to adjust its own emissions in real time; this has the purpose of instantaneously generating the most suitable frequencies for the homogenization treatment of the fluid arriving in the duct, since said fluid needs an immediate adjustment of the treatment frequency in real time, whenever the flow of fluid changes its velocity or the viscosity of said fluid changes.

The apparatus, according to the invention, when applied in those industrial processes which use conveyed fluids having changeable values of viscosity and velocity, gives surprising fluid homogenization in almost newtonian conditions never obtained before, with stochiometric results of process never obtained before, thanks to the precision of the continuous adjustment of the frequencies in real time.

A fluid constituted of several components, which have different densities, when submitted to a translation action inside a duct, causes several known phenomena:

the concentration of the heaviest particles of the fluid in position of minimum disturbance and friction, that is in the center of the fluid vein;

the projection of the heaviest particles, by centrifugal force, whenever the duct compels the fluid flux to change its direction;

the accumulation of said particles in dead areas inside the duct or inside the vessel, whenever the fluid decreases its velocity;

the alteration of the aggregation status between the components which constitute the fluid at the end of its transportation inside the duct at the very moment of the start of the reaction, in one of manifold industrial processes.

up to the present time, apparatuses are known which use ultrasonic waves for fluid treatments by various means.

Fluids are placed in closed vessels to be treated, and equipments are employed which use manual and easily adjustable frequency ranges. In this way it is possible to treat small quantities of fluids and the system cannot be inserted in a continuous process.

Apparatuses are also known which use ultrasonic waves to treat moving fluids in plants where constant values of temperature, viscosity and velocity of said fluids are assured. Those apparatuses need manual adjustment when the process starts. Consequently, whenever the physical parameters of the fluid change, the technician in charge must adjust again the operating frequency of the apparatus.

In some cases a limited degree of self-governing has been obtained by means of thermostats, viscosimeters and measure metering flanges. Those accessories give slow responses which need to be transformed in signals suitable for the self-governing set of the ultrasonic waves generator. This double delay produces only a partial treatment of the fluid. Moreover, it is known that a conveyed fluid presents variations in physical parameters, often in opposition to each other. In such a case the signal translator becomes critical and does not perform its adjusting task. At this time one or more technicians must step in to reset the whole treatment system.

All the limitations and inconveniences present in the known prior art, i.e. limited quantities of treated fluids, partial efficiency of treatment, continuous operating interventions of technicians, have been brilliantly overcome by the present apparatus, which treats a large quantity of fluids, assures a high efficiency of the treatment, and above all is completely self-governing, after the first and sole initial set up, when the apparatus is installed.

These advantages come from the invention by having combined in a unique system the double function of treatment and self-rectifying of the generator, by means of a continuous detection which compares itself with prefixed parameters, without the presence of operators.

The combination in a unique and highly reliable system of said functions allows to obtain qualitative and quantitative results which were not possible to obtain with the prior art.

BRIEF DESCRIPTION OF THE DRAWINGS

The invention will be further explained with reference to a preferred embodiment thereof in conjunction with the accompanying drawing, the only FIGURE of which shows a diagrammatic view partially in section of the apparatus according to the invention.

DESCRIPTION OF THE PREFERRED EMBODIMENT

In the drawing FIGURE, FF indicates the direction of fluid flux for be treated inside the duct 2. The apparatus 9 is a generator of ultrasonic waves on different ranges of frequency, ranges chosen among those suitable to the fluid to be treated.

The apparatus is preferably fed by means of single-phase electric energy at low voltage, 220 V, 50 or 60 Hz.

The electric current suitable to produce the ultrasonic waves is generated by an oscillator (generator 8), made with quartz crystals, condensers, resistances, thyristors, semiconductors and connections, fit to generate currents with manifold frequencies according to the requirements, provided that to different parameters of velocity and viscosity to fluid to be treated, there correspond different optimal treatment frequencies.

The cables 6A–6B are made each by a conductor of suitable section, having constant ohmic characteristics, with coaxial shield and placed in a metallic duct. The cable 6A connects a generator 8 with the transducer 3 which comprises a bulb consisting of a single body with two openings, preset to emit two separate beams of ultrasonic directed waves. The task of the waves TZ affecting the treatment zone located upstream of the transducer is to treat the arriving fluid by dispersing the molecules of elements in uniform way inside the whole fluid, which assumes a constant viscosity in all the points of its flux.

Possible changes in parameters of velocity or viscosity in the arriving fluid, are shown as alterations of the perfect homogeneousness before obtained. These alterations are signalled by waves SA which cross a portion of the treated fluid downstream the treating zone affected by waves TZ.

Said waves SA are suitably reflected by a disc 4 towards the receiver 5 which through the cable 6B sends the detected signal to the analyzer 7.

Having started the correct treatment of the fluid by means of waves TZ, with constant fluid conditions of velocity and viscosity, waves SA cross a portion of fluid facing a constant resistance to their passage and to their refraction. The signal from the receiver 5 is revealed as constant and regular by the analyzer 7 and this constant condition keeps a well-balanced situation into the system interacting between analyzer 7 and generator 8, so that the last goes on generating a current at the same frequency.

In case of alterations in viscosity and/or velocity values of the arriving fluid that is the homogeneousness conditions result alterated, it is necessary to change the frequency of TZ waves.

These alterations in the status of fluid are detected by SA waves which do not face anymore a constant resistance to their crossing and the scanning made by receiver 5 presents discontinuities in signals, discontinuities which may be eventually scanned with a cathode ray oscilloscope.

Analyzer 7 also includes a binary circuit, which on the basis of purity of the received signal, accepts or rejects it; accepting it, means that the frequency of the generator 8 is that suitable to go on with the treatment of arriving fluid.

Analyzer 7 blocks arriving signals which present irregularities or distortions, activating another crystal and related circuit with higher frequency, following on this way, until the operating frequency of the waves meets the optimal value in the treatment zone. This is the case in which it is necessary to raise the operating frequency of the generator 8 because of the raised aggregation status of arriving elements into the fluid, or of the increased velocity of flux. In case of decreased velocity and/or viscosity of arriving fluid, it will be necessary to decrease the frequency of TZ waves.

The beam of SA waves facing a decreased resistance in crossing the fluid, takes an incidence angle which gets away from disc 4 downwards so that the beam of reflected waves to receiver 5 results more sharpened, that is SA waves flex so much downwards that instead of reflecting on disc 4, they are scattered in the front area of said disc.

In these conditions of proor or null refraction, signals detected by receiver 5 are not sufficient to maintain well-balanced the system interacting between analyzer 7 and generator 8, so that the analyzer 7 puts in operation a crystal and related circuit having lower frequency characteristic, until emissions from generator 8 are stopped in case of stopped flux of fluid.

The elapsed time between generated-issued-received-analyzed-rectified-generated etc. signals is very short, so that the fluid is treated in real time, according to its immediate requirements.

I claim:

1. An apparatus for treating and homogenizing fluids constituted of several chemical components, by means of ultrasonic waves, comprising a generator of ultrasonic waves, a duct for passing therein a fluid to be treated, a transducer in said duct connected to said generator for emitting said ultrasonic waves in said duct and treating said fluid flowing inside said duct, a receiver in said duct facing said transducer for detecting waves passed through the fluid flowing inside the duct and emitting a detection signal, said generator being of the type generating a unique ultrasonic signal for treating the fluid and controlling the frequency of said ultrasonic signal according to the viscosity and/or the flow rate of the fluid to be treated, said transducer having a single bulb body protruding within said duct and having two openings for emitting two separate beams of said ultrasonic waves generated by said generator, said duct defining a first treatment zone where a first beam of ultrasonic waves performs a treating and homogenizing action on the fluid flowing inside the duct and a second zone, downstream said first zone, where a second beam is received from said receiver for controlling the homogeneity of the treated fluid.

2. An apparatus according to claim 1, comprising a shield arranged in said duct interposed in the path of said second beam and reflecting said second beam towards said receiver with a different reflection angle varying in accordance with the flow rate and/or viscosity of the fluid.

3. An apparatus according to claim 1, comprising a signal analyzer, a first and a second cable connecting said receiver and said generator to said signal analyzer, said signal analyzer including a binary circuit system receiving said detection signal from said receiver and, on the basis of the purity of the detection signal, accepting or rejecting it, maintaining or changing balance between said detection signal and said ultrasonic signal emitted by the generator for reaching the most suitable wave frequency required for the proper homogenizing treatment in real time.

* * * * *